US012497859B2

(12) United States Patent
Fripp et al.

(10) Patent No.: US 12,497,859 B2
(45) Date of Patent: Dec. 16, 2025

(54) WELLBORE SUBSURFACE SAFETY VALVE USING A MAGNETIC COUPLING

(71) Applicant: Halliburton Energy Services, Inc., Houston, TX (US)

(72) Inventors: Michael Linley Fripp, Singapore (SG); Mohan Gunasekaran, Singapore (SG); Deepesh Upadrashta, Singapore (SG); Jon-Howard Elliott Hanson, Carrollton, TX (US); Matthew Gassen, Carrollton, TX (US); Rajiv Jerome Yatawara, Carrollton, TX (US); Jason Lee Peacock, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/673,958

(22) Filed: May 24, 2024

(65) Prior Publication Data

US 2025/0361788 A1 Nov. 27, 2025

(51) Int. Cl.
*E21B 34/06* (2006.01)

(52) U.S. Cl.
CPC ..... *E21B 34/066* (2013.01); *E21B 2200/05* (2020.05)

(58) Field of Classification Search
CPC ..... E21B 34/066; E21B 2200/05
See application file for complete search history.

(56) References Cited

U.S. PATENT DOCUMENTS

| | | | | |
|---|---|---|---|---|
| 6,988,556 | B2 | 1/2006 | Vick, Jr. | |
| 8,038,120 | B2 | 10/2011 | Vick, Jr. et al. | |
| 9,371,923 | B2 | 6/2016 | Fullerton et al. | |
| 11,374,480 | B2 | 6/2022 | Ornelaz et al. | |
| 11,891,870 | B2 | 2/2024 | Maher et al. | |
| 2005/0087335 | A1 | 4/2005 | Vick, Jr. | |
| 2007/0289734 | A1* | 12/2007 | McDonald | E21B 34/06 166/66.5 |

(Continued)

FOREIGN PATENT DOCUMENTS

| | | |
|---|---|---|
| WO | 2013039663 | 3/2013 |
| WO | 2017105341 | 6/2017 |

OTHER PUBLICATIONS

"PCT Application Serial No. PCT/US2024/031204, International Search Report and Written Opinion", Feb. 22, 2025, 11 pages.

*Primary Examiner* — Taras P Bemko
(74) *Attorney, Agent, or Firm* — DeLizio, Peacock, Lewin & Guerra LLP

(57) ABSTRACT

A subsurface safety valve for a wellbore for production of fluids from a subsurface formation comprises a drive portion and an actuator portion. The drive portion comprises a first magnet assembly and the actuator portion comprises a second magnet assembly that is magnetically coupled to the first magnet assembly. At least one of the first magnet assembly or the second magnet assembly comprises a spatially rotated array of magnets arranged such that a magnetic field emitted from an operative side of the spatially rotated array of magnets facing a magnetic coupling is non-zero and such that the magnetic field emitted from a non-operative side of the spatially rotated array of magnets that is opposite the operative side is about zero.

24 Claims, 10 Drawing Sheets

(56) References Cited

U.S. PATENT DOCUMENTS

| | | | | |
|---|---|---|---|---|
| 2011/0120727 | A1* | 5/2011 | Lake | F16K 31/082 166/66.7 |
| 2014/0020887 | A1* | 1/2014 | Vick, Jr. | E21B 34/066 166/66.5 |
| 2016/0208579 | A1 | 7/2016 | Delzell et al. | |
| 2016/0312589 | A1 | 10/2016 | Decarlo | |
| 2018/0311795 | A1* | 11/2018 | Morton | B23Q 3/1546 |
| 2020/0244154 | A1* | 7/2020 | Ornelaz | H02K 49/102 |
| 2021/0285301 | A1* | 9/2021 | Maher | E21B 31/06 |
| 2023/0399919 | A1* | 12/2023 | Passmore | E21B 34/066 |
| 2024/0125203 | A1* | 4/2024 | Xiao | E21B 34/066 |
| 2024/0175335 | A1* | 5/2024 | Chouzenoux | E21B 34/16 |

* cited by examiner

WELLBORE SUBSURFACE SAFETY VALVE USING A MAGNETIC COUPLING

BACKGROUND

Hydrocarbons and similar substances may exist in underground deposits and can be extracted by various means, such as drilling wells and using pumps to lift the substance to the surface. In some instances, the weight of the ground pressurizes the underground deposit. When a well is drilled into a pressurized underground deposit, the pressure may force the substance to the surface without mechanical help (e.g., a pump). In these scenarios, mechanisms may be used to limit the rate at which the substance is forced to the surface. However, if these mechanisms fail, an uncontrolled release of the substance, typically referred to as a "blowout", may occur, sometimes with devastating consequences. Safety valves can be utilized to forcefully close the well when the rate limiting mechanism fails, mitigating the risks associated with potential blowouts and other problems.

BRIEF DESCRIPTION OF THE DRAWINGS

Embodiments of the disclosure may be better understood by referencing the accompanying drawings.

DESCRIPTION

Figure 1:
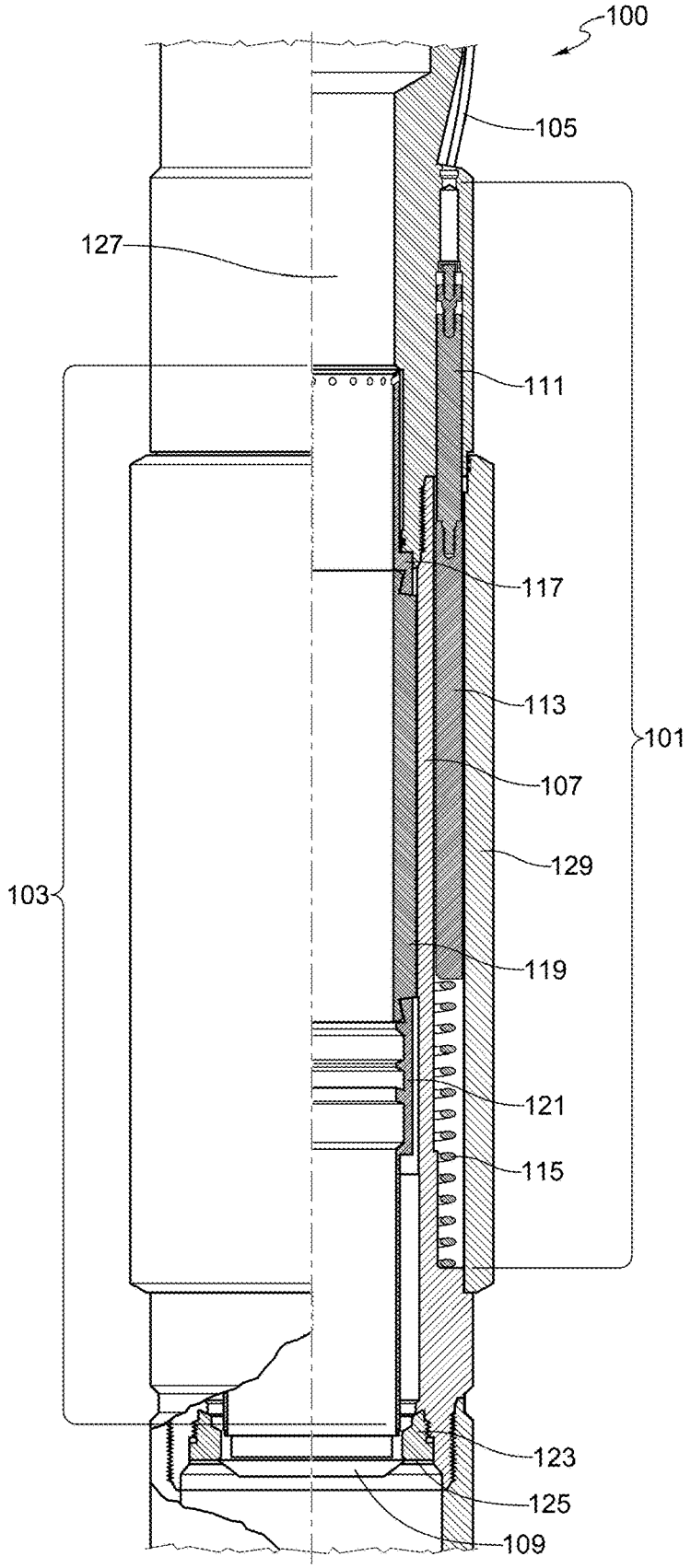
FIG. 1 depicts a cut-away view of a subsurface safety valve that uses a magnetic coupling for opening and closing, according to some implementations.

The description that follows includes example systems, methods, techniques, and program flows that embody aspects of the disclosure. However, it is understood that this disclosure may be practiced without these specific details. For example, although the description herein refers to hydrocarbons, the subject matter described may apply to other substances. As another example, although the description and figures herein depict vertical wellbores, wellbores may be vertical, horizontal, or any angle in between. In some instances, well-known instruction instances, protocols, structures, and techniques have not been shown in detail in order not to obfuscate the description.

Example implementations may include a subsurface safety valve used downhole in a wellbore to prevent uncontrolled releases of hydrocarbons during hydrocarbon production from the wellbore. In some implementations, the subsurface safety valve may include a magnetic coupler that may minimize or eliminate the need for non-magnetic materials in components of the subsurface safety valve. Additionally, example implementations may include a subsurface safety valve that may increase the coupling force therein (thereby allowing for a shorter magnetic coupler).

In some implementations, a subsurface safety valve may include a drive portion and an actuator portion that are magnetically coupled and used to open and close the subsurface safety valve. During operation of the subsurface safety valve, when hydraulic pressure is applied to the drive portion via a hydraulic input, the hydraulic pressure causes the drive portion of the subsurface safety valve to move linearly along the wellbore, compressing a spring. Because the drive magnet assembly is magnetically coupled with the actuator portion (which includes a follower magnet assembly), the actuator portion moves in conjunction with the drive portion. Thus, as the drive portion moves linearly along the wellbore, the actuator portion also moves linearly along the wellbore. After sufficient movement, the lower cap of the actuator portion makes contact with the safety valve flapper and, with further movement, causes the subsurface safety valve flapper to rotate about the hinge and open.

Accordingly, the use of a magnetic coupling between the drive portion and the actuator portion allows the safety valve to operate despite being sealed off from the drive portion, reducing the potential for leaks and other problems. However, as the distance between the inner and outer magnetic assembl(y/ies) increases, the strength of the magnet coupling decreases, placing a limit on the thickness of the pressure separator, and thus limiting the amount of pressure such a mechanism can operate under. Further, magnet assemblies produce magnetic flux on both sides of the magnet assemblies, limiting the use of ferrous materials around the magnetic assemblies. As such, non-ferrous materials that are expensive and difficult to work with, like Inconel, may be required.

As further described below, the magnetic coupling in the subsurface safety valve may be used for coupling a drive portion with an actuator portion in the subsurface safety valve. In contrast to conventional approaches, example implementations may include a subsurface safety valve having a spatially rotated array of magnets as part of this magnetic coupling. In some implementations, a spatially rotated array of magnets may be included in at least one of the drive portion or the actuator portion.

In some implementations, a spatially rotated magnetic array may be used for both the drive portion and the actuator portion. Alternatively, the spatially rotated magnetic array may be on just one side (either the drive portion or the actuator portion). The other side may include a magnetic array that includes the flipping N-S-N-S arrangement.

The spatially rotated array of magnets may be configured such that the magnetic field is increased on one side of the array and is nearly zero on the other side of the array. In some implementations, this array may achieve this result by having sequential magnets at different orientations in a spatially rotating pattern of magnetization. For example, some implementations may replace the N-S alternating pairs of magnets with the spatially rotated array of magnets.

As further described below, the magnetic field on the backside of the array of magnets is not cancelled. Instead, the magnetic flux may be contained within a magnetic circuit and thus does not emanate from the non-working surface. Such implementations may eliminate or significantly reduce the magnetic field on the sides away from the magnetic coupling. Further, magnet assemblies produce magnetic flux on both sides of the magnet assemblies, limiting the use of ferrous materials around the magnetic assemblies. As such, conventional approaches may require the use of non-ferrous materials for components of the subsurface safety valve. Such material may be expensive and difficult to work with, like Inconel. In contrast, example implementations may not require the use of non-ferrous materials for the manufacturing of a subsurface safety valve-thereby significantly reducing the cost of the subsurface safety valve. Additionally, example implementations may increase the amount of force within the magnetic coupling in the subsurface safety valve without increasing a length of the coupling.

In some implementations, the array of magnets may be aided with the use of a ferromagnetic backing plate. Such implementations may enable an outer housing and the flow tube to be constructed from a ferromagnetic steel. This may not only be less expensive but also would increase the coupling force from the array of magnets.

In some implementations, the components of the magnetic assembly do not have to be the same length. For example, the magnetic segments that have the field pointing towards the other coupler may be longer than the magnetic segments where the field is pointing parallel to the assembly.

In some implementations, the magnet assembly may be a pre-assembled assembly where the assembly includes permanent magnets and a tension element. The magnets in the spatially rotated array may want to separate themselves. Accordingly, the tension element may hold them together. In some implementations, the tension element may be a metal rod that runs through the center of the magnets. In some other implementations, the tension element may be a metal tube into which the magnets are inserted. The metal tube may be crimped, glued, or sealed to hold the magnets in close proximity to each other. Spacers may be placed between the magnets.

In some implementations, the array of magnets may be a Halbach array of magnets. In some implementations, the array of magnets may be a bucking magnet configuration. In a bucking magnet array, the magnets may be spatially rotated at increments other than 90 degrees. For example, the magnets may be placed at 45 degree increments. The higher number of steps in the array (smaller angular increment) may result in a more homogenous and stronger field output.

Example implementations may include an array of magnets in a same spatial envelope that provide a higher flux density (higher coupling force) as compared to conventional approaches. Accordingly, this may allow for the use of a wider range of spring forces without a risk of de-coupling the magnetic sleeves (of the drive and actuator portions). Example implementations may include a higher coupling force in the same spatial envelope as conventional approaches. Also, as further described below, the use of the array of magnets as described herein (e.g., a spatially rotated array of magnets) may enable the successful scaling to both larger and smaller diameter designs.

In contrast to example implementations, a typical magnet assembly consists of a plurality of magnets arranged with each magnet oriented such that the poles of each successive magnet are rotated 180 degrees relative to the previous magnet. Thus, the south pole of a first of the magnets mates with the south pole of a first adjacent magnet and the north pole of the magnet mates with the north pole of a second adjacent magnet opposite of the first adjacent magnet.

The drawbacks associated with the above safety valve actuation mechanism can be mitigated by using one or more spatially rotated arrays of magnets. A spatially rotated array of magnets is a magnet assembly where each magnet of the magnet assembly has an orientation that is rotated between 0 and 180 degrees relative to the orientation of at least one adjacent magnet. Such a magnet assembly implementation biases the magnetic flux to an operative side of the magnet assembly, thereby increasing the magnetic coupling force on the operative side while decreasing the amount of magnetic flux on the non-operative side. The increased magnetic coupling force can allow for thicker pressure separators, giving the safety valve actuation mechanism a greater operational range. Further, the decreased magnetic flux on the non-operative side can allow for use of cheaper, easier-to-work-with ferrous materials.

Example Subsurface Safety Valve

FIG. 1 depicts a cut-away view of a subsurface safety valve that uses a magnetic coupling for opening and closing, according to some implementations. FIG. 1 depicts a portion of a subsurface safety valve 100 comprising a drive portion 101, an actuator portion 103, a hydraulic input 105, a pressure separator 107, a safety valve flapper 109, and an outer wall 127. The drive portion 101 comprises a drive mechanism 111, a drive magnet assembly 113, and a spring 115. The actuator portion 103 comprises an upper cap 117, a follower magnet assembly 119, and a lower cap 121. The safety valve flapper 109 is coupled with a safety valve seat 123 via a hinge 125.

In operation, as described above, hydraulic pressure is applied to the drive mechanism 111 via the hydraulic input 105. The hydraulic pressure causes the drive mechanism 111 to apply force to the drive magnet assembly 113, causing the drive magnet assembly 113 to compress the spring 115. Thus, the hydraulic pressure applied via the hydraulic input 105 causes the drive portion 101 to move linearly within the outer housing 129 (downward, in this example).

Because the drive magnet assembly 113 is magnetically coupled to the follower magnet assembly 119, as the drive portion 101 moves downward within the outer housing 129, the actuator portion 103 also moves downward within the outer housing 129. As the actuator portion 103 moves downward within the outer housing 129, the lower cap 121 makes contact with the safety valve flapper 109, causing the safety valve flapper 109 to rotate about hinge 125 and open. When open, the safety valve flapper 109 allows hydrocarbons to flow upwards.

When the pressure applied via the hydraulic input 105 decreases, the force from the compressed spring 115 forces the drive magnet assembly 113 upwards. As the drive magnet assembly 113 moves upwards, the magnetic coupling between the drive magnet assembly 113 and the follower magnet assembly 119 causes the actuator portion 103 to move upward as well. As the lower cap 121 moves above the safety valve flapper 109, the safety valve flapper 109 rotates about the hinge 125 and closes, halting the upward flow of the hydrocarbons.

At least one of the drive magnet assembly 113 and the follower magnet assembly 119 may comprise a spatially rotated array of magnets where each of the spatially rotated arrays of magnets comprises a plurality of magnets having orientations rotated between 0 and 180 degrees relative to at least one adjacent magnet of the plurality of magnets, as described in more detail below.

Some implementations may include a spatially rotated array of magnets arranged such that a magnetic field emitted from the spatially rotated array of magnets is biased towards an operative side of the spatially rotated array of magnets (as compared to a non-operative side of the spatially rotated array of magnets). The amount of bias may vary between implementations and may depend on various factors, such as the depth of the subsurface safety valve 100, the distance between the drive magnet assembly 113 and the follower magnet assembly 119, and the type of materials used in the subsurface safety valve 100. In some implementations, the non-operative side of the spatially rotated array of magnets has a magnetic field that is about zero.

For the purposes of the descriptions herein, the non-operative side of the spatially rotated array of magnets having a magnetic field of "about zero" means that the magnetic field on the non-operative side of the spatially rotated array of magnets is between 0% and 10% of the total magnetic field emitted by the spatially rotated array of magnets as measured at a distance that is one half of the thickness of the magnet assembly or that the average magnetic field on the non-operative side of the spatially rotated array of magnets is less than 25% of the average magnetic field on the operative side.

In some implementations, the array of magnets may be a Halbach array of magnets. In some implementations, the array of magnets may be a bucking magnet configuration. In a bucking magnet array, the magnets may be spatially rotated at increments other than 90 degrees. For example, the magnets may be placed at 45-degree increments. The higher number of steps in the array of magnets (i.e., having smaller angular increments) may result in a more homogenous and stronger field output.

The hydraulic input 105 may be mechanically or electrically coupled with one or more rate-limiting mechanisms (not depicted) that limit the rate at which the hydrocarbons flow upward such that when one or more of the rate limiting-mechanisms fails, the pressure applied via the hydraulic input 105 falls, causing the subsurface safety valve 100 to close.

Although the descriptions herein describe subsurface safety valves that use a flapper mechanism, other mechanisms may be used. For example, instead of a safety valve flapper 109, the subsurface safety valve 100 may be modified to use a ball valve, pinch valve, gate valve, etc., with the movement of the actuator portion 103 being adapted to operate the particular valve type used in the implementation.

Example Spatially Rotated Array of Magnets

Figure 2:
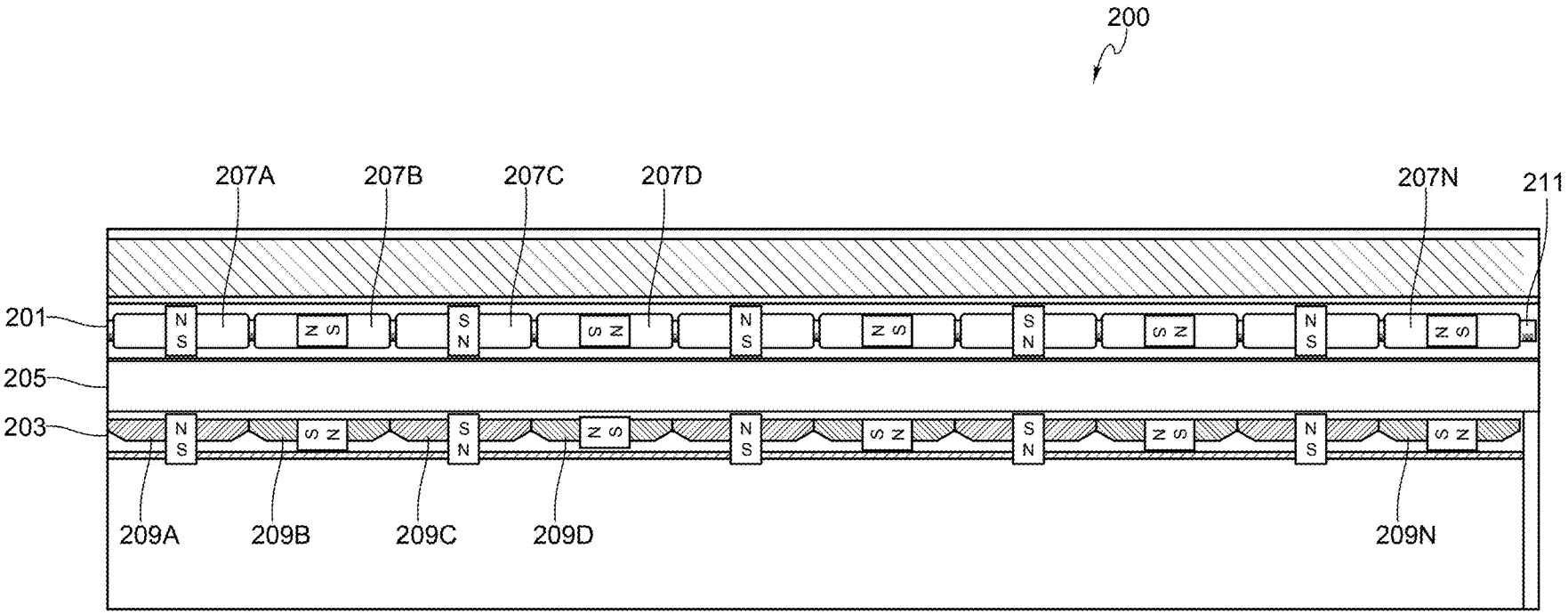
FIG. 2 is a detailed cross-sectional view of a pair of magnet assemblies used for actuating a subsurface safety valve, according to some implementations.

FIG. 2 is a detailed cross-sectional view of a pair of magnet assemblies used for actuating a subsurface safety valve, according to some implementations. FIG. 2 depicts a pair of magnet assemblies 200 that may be incorporated into a subsurface safety valve. For example, the pair of magnet assemblies 200 may be incorporated into the subsurface safety valve 100 depicted in FIG. 1. The pair of magnet assemblies 200 comprises a drive magnet assembly 201, an actuator magnet assembly 203, and a pressure separator 205. The magnets of the drive magnet assembly 201 are maintained in position relative to each other by a rod 211 inserted through the magnets. A magnetic coupling may be established between the drive magnet assembly 201 and the actuator magnet assembly 203. With reference to FIG. 1, the drive magnet assembly 201 and the actuator magnet assembly 203 may be part of the drive portion 101 and the actuator portion 103, respectively.

The drive magnet assembly 201 comprises a first plurality of magnets 207A-N wherein the orientation of each magnet of the plurality of magnets is rotated between 0 and 180 degrees from at least one adjacent magnet of the plurality of magnets. For example, the first magnet 207A is depicted with a vertical orientation having the north pole on the top while the second magnet 207B is depicted with a horizontal orientation having the north pole to the left. Thus, the second magnet 207B has an orientation that is rotated 90 degrees counterclockwise relative to the orientation of the first magnet 207A. Similarly, the third magnet 207C is depicted with a vertical orientation having the north pole to the bottom, thus having an orientation that is rotated 90 degrees counterclockwise relative to the orientation of the second magnet 207B. Completing the pattern, the fourth magnet 207D is depicted with a horizontal orientation having the north pole to the right, thus having an orientation that is rotated 90 degrees counterclockwise relative to the orientation of the third magnet 207C. For magnet assemblies with more than four magnets, like the drive magnet assembly 201, this pattern may repeat multiple times.

The actuator magnet assembly 203 comprises a second plurality of magnets 209A-N wherein the orientation of each magnet of the plurality of magnets is rotated between 0 and 180 degrees from at least one adjacent magnet of the plurality of magnets. For example, the first magnet 209A is depicted with a vertical orientation having the north pole on the top while the second magnet 209B is depicted with a horizontal orientation having the north pole to the right. Thus, the second magnet 209B has an orientation that is rotated 90 degrees clockwise relative to the orientation of the first magnet 209A. Similarly, the third magnet 209C is depicted with a vertical orientation having the north pole to the bottom, thus having an orientation that is rotated 90 degrees clockwise relative to the orientation of the second magnet 209B. Completing the pattern, the fourth magnet 209D is depicted with a horizontal orientation having the north pole to the left, thus having an orientation that is rotated 90 degrees clockwise relative to the orientation of the third magnet 209C. For magnet assemblies with more than four magnets, like the actuator magnet assembly 203, this pattern may repeat multiple times.

The magnets of the pluralities of magnets 207A-N and 209A-N may vary in shape, size, material, and other aspects, both relative to the other plurality of magnets and relative to other magnets within the same plurality. For example, the magnets in the first plurality of magnets 207A-N may be a different size or different number than the magnets in the second plurality of magnets 209A-N. As another example, the magnets in the first plurality of magnets 207A-N may consist of multiple sizes or shapes that differ from one magnet to the next.

As another example, FIG. 2 depicts the first plurality of magnets 207A-N as having a rectangular cross section and depicts the second plurality of magnets 209A-N as having a keystone-shaped cross-section. However, both pluralities of magnets 207A-N and 209A-N may use magnets having the same shape. Similarly, the cross-sectional shape of the magnets is not limited to being rectangular or keystone-shaped.

Further, the amount of rotation between successive magnets of the plurality of magnets 207A-N may vary. For example, instead of each magnet of the plurality of magnets

207A-N having an orientation that is rotated 90 degrees relative to at least one adjacent magnet, some implementations may have some magnets with an orientation that is rotated 90 degrees relative to at least one adjacent magnet and some magnets with an orientation that is rotated 45 degrees relative to at least one adjacent magnet.

As noted above, FIG. 2 is a cross-sectional view of the magnet assemblies. Although implementations can vary, magnet assemblies like the magnet assembly 200 may have a tubular shape. As such, the magnets of the plurality of magnets 207A-N and the magnets of the plurality of magnets 209A-N may be ring-shaped such that they encircle the tubular interior of the magnet assembly 200. They may be continuous or composed of a plurality of magnets arranged in a ring-shape. When composed of a plurality of magnets arranged in a ring-shape, the plurality of magnets may abut each other or may be spaced apart at either regular or irregular intervals. Further, in some implementations, the magnets may not completely encircle the tubular interior of the magnet assembly 200 and may even be a single linear array of magnets.

The actual construction of a magnet assembly can vary. For example, in some implementations the magnets may be enclosed in metal receptacle that includes top and bottom caps, a backing plate, and a front plate, with the receptacle being responsible for preventing the magnets from separating. In other implementations, the receptacle can be constructed from a polymer and can have a relative magnetic permeability of less than 10. In some implementations, the magnets may be held together via a rod inserted through the magnets, a bracket connecting each of the magnets, adhesives, a clamping mechanism, or any other mechanism usable to hold the magnets together. In some implementations, the magnets may be directly inserted into a cavity within an existing structure. For example, the magnets used in a drive magnet assembly might be inserted into a space between a pressure separator and an outer wall and directly abut one or more of the drive spring and the hydraulic input mechanism.

Figure 3:
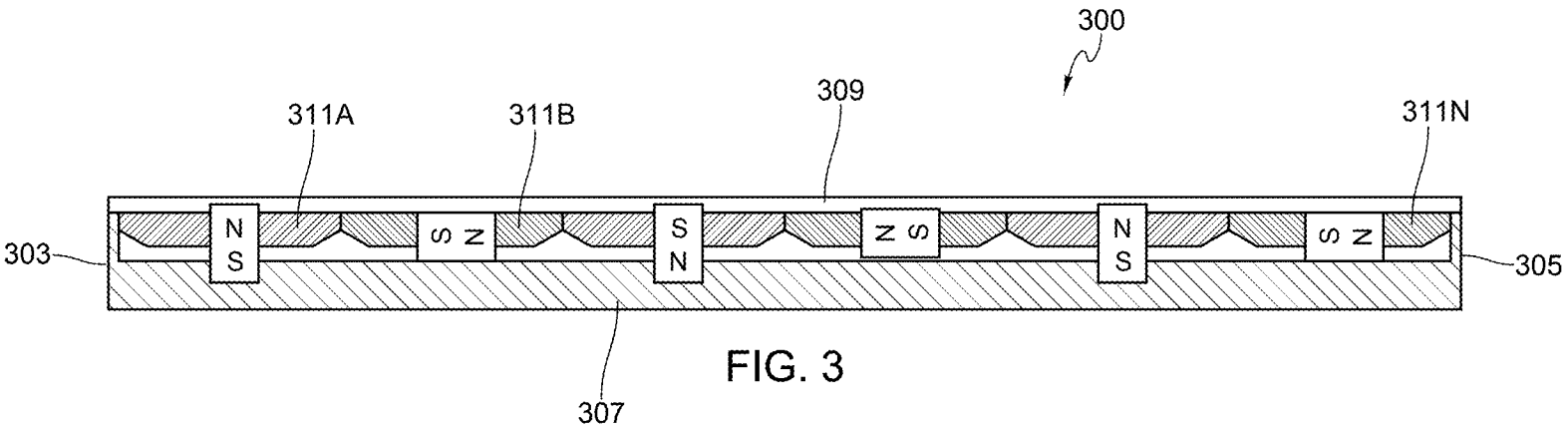
FIG. 3 is a detailed cross-sectional view of a magnet assembly usable for actuating a subsurface safety valve, according to some implementations.

FIG. 3 is a detailed cross-sectional view of a magnet assembly usable for actuating a subsurface safety valve, according to some implementations. FIG. 3 depicts a magnet assembly 300 comprising a first end 303, a second end 305, a backing plate 307, a top plate 309, and a plurality of permanent magnets 311A-N. The first end 303, second end 305, backing plate 307, and top plate 309 comprise a receptacle or enclosure. With reference to FIG. 1, the magnet assembly 300 may be incorporated into at least one of the drive portion 101 or the actuator portion 103 for opening and closing the subsurface safety valve 100.

The magnet assembly 300 receptacle (e.g., the first end 303, the second end 305, the backing plate 307, and the top plate 309) can be formed using various techniques. For example, the first end 303 and second end 305 may be formed by welding, screwing, clamping, or pinching the ends of the backing plate 307 and the top plate 309 together. In some implementations, the first end 303 and the second end 305 may be separate components from the backing plate 307 and the top plate 309 and may be coupled to one or both of the backing plate 307 and the top plate 309 by welding, screwing, clamping, adhesive bonding, mechanically fitting the ends of each component together, or by any other usable means. In some implementations, the first end 303 and the second end 305 may be integral with the backing plate 307 (as depicted in FIG. 3) or the top plate 309.

As noted above, the specific construction of the magnet assembly 300 can vary and the specific degree the orientation of each magnet may be rotated relative to the adjacent magnet(s) may vary. In this example, each magnet has its orientation rotated 90 degrees relative to the orientation of the adjacent magnets but other implementations may have the magnet orientations rotated 45 degrees relative to the orientation of the adjacent magnets. More generally, each magnet of magnet assembly 300 may have an orientation that is rotated between 0 and 180 degrees relative to the adjacent magnet(s).

As noted above, a magnet assembly utilizing magnets with alternating polarities (i.e., utilizing magnets with orientations that are rotated 180 degrees relative to the adjacent magnet(s)) produce magnetic flux that is effectively equal on each side of the assembly. However, a magnet assembly utilizing magnets with orientations that are rotated between 0 and 180 degrees relative to at least one adjacent magnet can emit more flux on one side of the assembly than the other. These latter magnet assemblies may still emit some small amount of flux from the weak side of the assembly, which, despite being weaker, may still interact with ferrous materials. In some implementations, the plurality of permanent magnets 311A-N are considered to be self-shunting.

Figure 4:
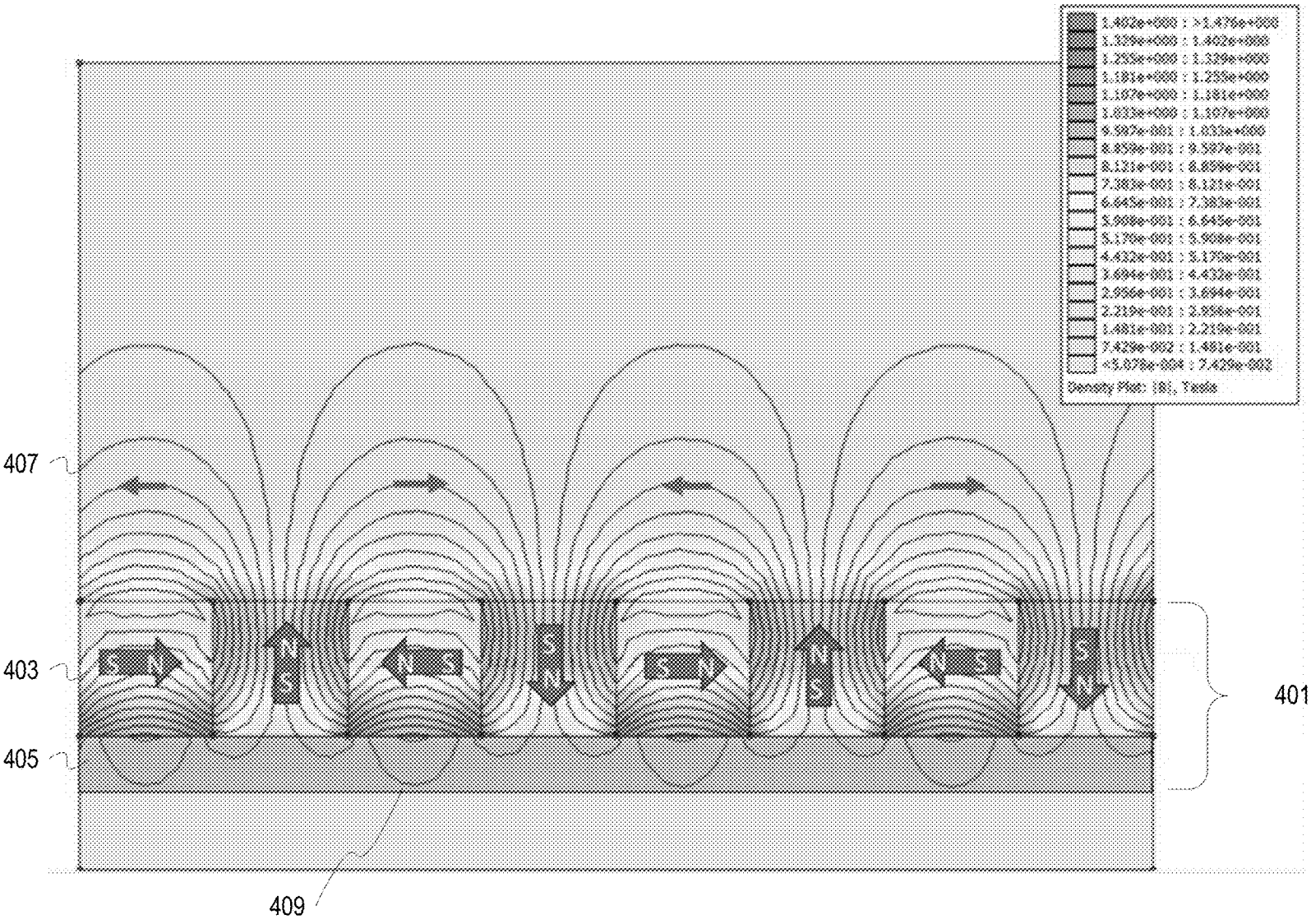
FIG. 4 shows the output of a simulation of a magnet assembly usable for actuating a subsurface safety valve, according to some implementations.

As illustrated in FIG. 4 below, the use of the backing plate 307 with the magnet assembly 300 may reduce the risk and/or complications associated with the use of ferrous materials on the weak side of the magnet assembly 300 by encapsulating the magnetic flux within the magnet assembly 300 itself. To put it another way, the backing plate may provide sufficient physical separation between the magnets 311A-N and material outside of the magnet assembly 300 that there is little to no interaction between the magnets and the material outside of the magnet assembly 300.

FIG. 4 shows the output of a simulation of a magnet assembly usable for actuating a safety valve, according to some implementations. FIG. 4 depicts a magnet assembly 401 comprising a backing plate 405 and a plurality of magnets 403 having orientations rotated 90 degrees relative to the orientation of at least one adjacent magnet. FIG. 4 also depicts magnetic flux lines 407 representing the simulated magnetic flux on the operative side of the magnet assembly 401 and magnetic flux lines 409 representing the simulated magnetic flux on the non-operative side of the magnet assembly 401.

As illustrated, the magnetic flux lines 407 are stronger and extend further than the magnetic flux lines 409, which is a characteristic of the magnets 311A-N. Further, the thickness of the backing plate 405 is sized such that the magnetic flux lines 409 are contained within the bounds of the backing plate 405. As such, ferrous material could abut the backing plate 405 without interacting with the magnetic flux generated by the magnet assembly 401.

Although the simulated flux lines illustrated in FIG. 4 are specific to a particular magnet assembly using magnets of a specific shape, size, orientation, and material, other magnet assemblies with similar arrangements of magnets (where the orientation of each magnet is rotated between 0 and 180 degrees relative to the orientation of at least one adjacent magnet) have similar flux characteristics and can be used in magnetic assemblies as discussed herein.

The examples above depict magnet assemblies with magnets having orientations rotated 90 degrees relative to the orientation of at least one adjacent magnet in the assembly. As described, however, the magnet orientations may be rotated by any degree between 0 and 180 degrees relative to the orientation of at least one adjacent magnet.

Figure 5:
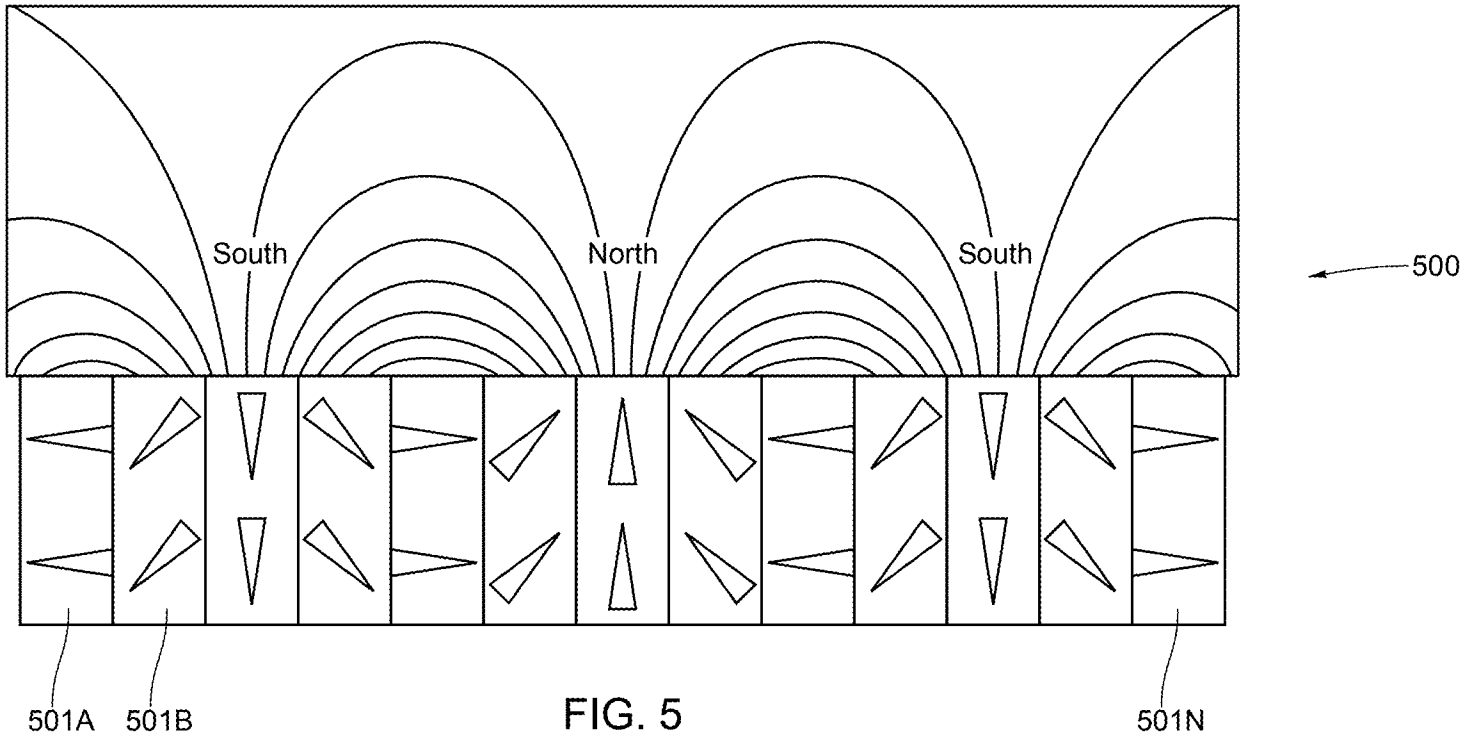
FIG. 5 is a diagram illustrating a magnet assembly with magnets having orientations rotated 45 degrees relative to the orientation of at least one adjacent magnet, according to some implementations.

FIG. 5 is a diagram illustrating a magnet assembly with magnets having orientations rotated 45 degrees relative to the orientation of at least one adjacent magnet, according to some implementations. FIG. 5 depicts a magnet assembly 500 comprising magnets 501A-501N. The orientation of each magnet is illustrated by the cones on each magnet. Magnet 501A is depicted as having a left-to-right orientation, while magnet 501B is depicted as having an orientation rotated 45 degrees counterclockwise relative to the orientation of 501B, with the same pattern repeated through magnet 501N.

The specific angular rotation of the magnet orientations used in a magnet assembly can vary depending on the magnet shapes, sizes, material, application specifications, etc. Furthermore, the specific angular rotation of the magnet orientations used in a magnet assembly can vary within the magnet assembly. For example, in a given assembly, the orientation of a first magnet may be rotated 90 degrees relative to the orientation of a magnet adjacent to the first magnet while the orientation of a second magnet may be rotated 45 degrees relative to the orientation of a magnet adjacent to the second magnet.

Thus, while the examples herein depict a small number of magnet arrangements in a magnet assembly, the angular rotation of the magnet orientations within a magnet assembly can be any amount greater than or equal to 0 degrees and less than 180 degrees, provided that not all magnets within a magnet assembly have the same orientation.

As used herein, the phrase "between 0 and 180 degrees" is exclusive of 0 and 180 degrees.

As used herein, the phrase "about 90 degrees" means between 60 and 120 degrees.

As used herein, the phrase "approximately x degrees" means x degrees +/− an amount sufficient to cover industry-typical manufacturing tolerances.

Example System

Figure 6:
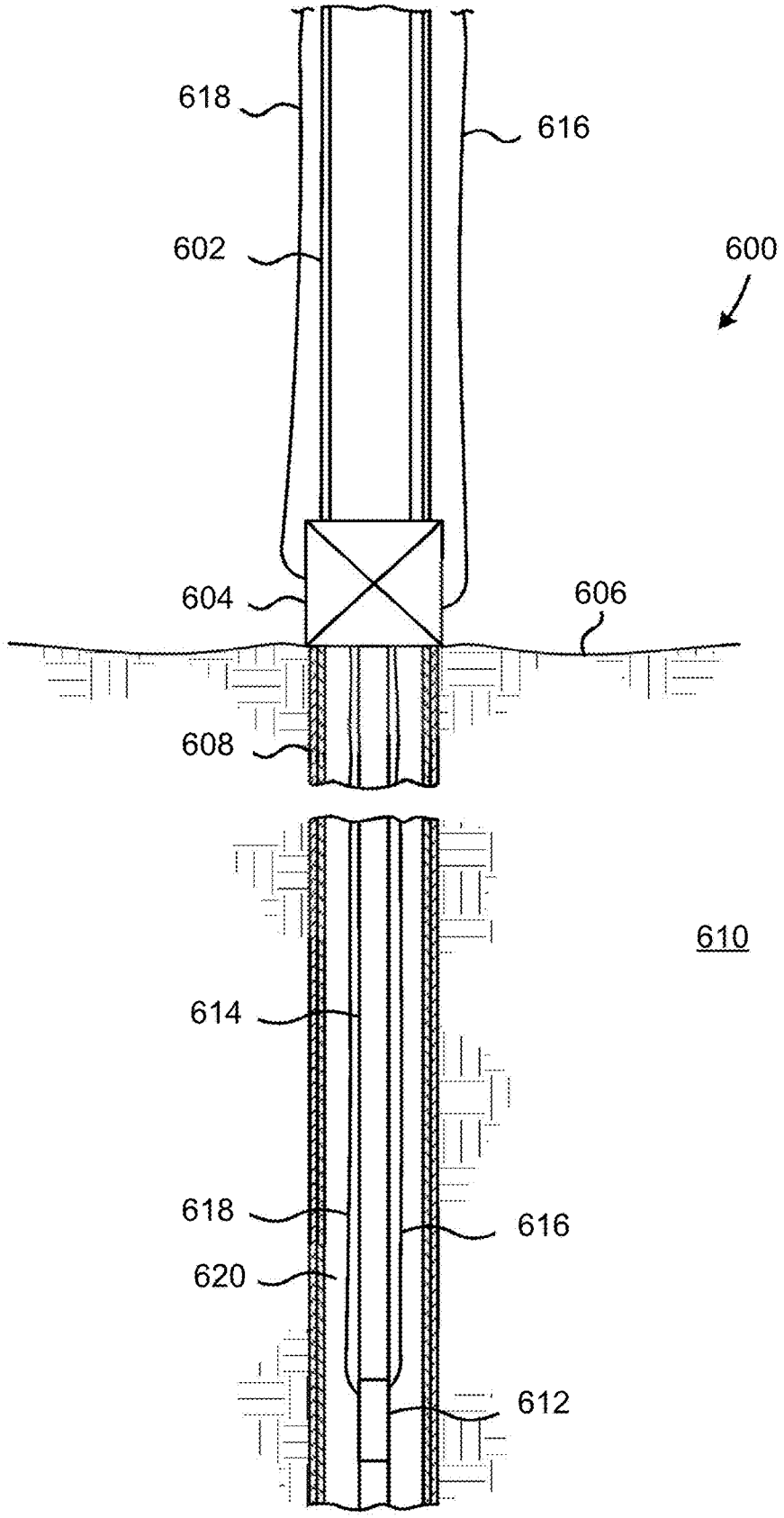
FIG. 6 is an elevation view in partial cross section of a well system having a subsurface safety valve, according to some implementations.

FIG. 6 is an elevation view in partial cross section of a well system having a subsurface safety valve, according to some implementations. As illustrated in FIG. 6, a well system 600 may include a riser 602 extending from a wellhead installation 604 positioned at a surface 606. The riser 602 may extend to a surface location. A wellbore 608 extends downward from the wellhead installation 604 through various subterranean formations 610. The wellbore 608 is depicted as being cased, but it could equally be an uncased wellbore 608.

The well system 600 may further include a subsurface safety valve 612 (hereafter "the safety valve 612") interconnected with a tubing 614 introduced into the wellbore 608 and extending from the wellhead installation 604. The tubing 614, which may comprise production tubing, may provide a fluid conduit for communicating fluids (e.g., hydrocarbons) extracted from the subterranean formations 610 to the well surface via the wellhead installation 604. A control line 616 and a balance line 618 may each extend to the wellhead installation 604, which, in turn, conveys the control and balance lines 616, 618 into an annulus 620 defined between the wellbore 608 and the tubing 614. The control and balance lines 616, 618 may originate from a control manifold or pressure control system (not shown) located at the well surface (i.e., a production platform), a control station, or a pressure control system located at the earth's surface or downhole. The control and balance lines 616, 618 extend from the wellhead installation 604 within the annulus 620 and eventually communicate with the subsurface safety valve 612.

As built into the tubing 614, the safety valve 612 may be referred to as a tubing retrievable safety valve (TRSV). The control line 616 may be used to actuate the safety valve 612 between open and closed positions. In some implementations, the control line 616 may be a hydraulic conduit that conveys hydraulic fluid to the safety valve 612. The hydraulic fluid may be applied under pressure to the control line 616 to open and maintain the safety valve 612 in its open position, thereby allowing production fluids to flow uphole through the safety valve 612, through the tubing 614, and to a surface location for production. To close the safety valve 612, the hydraulic pressure in the control line 616 may be reduced or eliminated. In the event the control line 616 is severed or rendered inoperable, or if there is an emergency at a surface location, the default position for the safety valve 612 may be the closed position to prevent fluids from advancing uphole past the safety valve 612 and otherwise preventing a blowout.

The balance line 618 may supply a balancing hydraulic force to compensate for the effects of hydrostatic pressure acting on the control line 616. More particularly, in order to enable the safety valve 612 to operate at increased depths, it is often necessary to balance the downhole hydrostatic forces assumed by the safety valve 612. The balance line 618 may supply hydraulic pressure to the safety valve 612 to provide a compensating force that overcomes such hydrostatic forces, thereby allowing the safety valve 612 to operate at increased wellbore depths.

Safety valve 612 may comprise a drive portion and an actuator portion, where the drive portion is magnetically coupled to the actuator portion, allowing the drive portion and the actuator portion to move in conjunction with each other without a physical coupling. The drive portion may be located outside of the tubing 614 and the actuator portion may be located inside of the tubing 614. The hydraulic pressure supplied by the control line 616 may be used to cause the drive portion to move linearly along the tubing 614, thereby causing the actuator portion to move linearly along the tubing 614, opening and closing the safety valve 612. One or both of the drive portion and the actuator portion may use a spatially rotated array of magnets.

Example Operations

Figure 7:
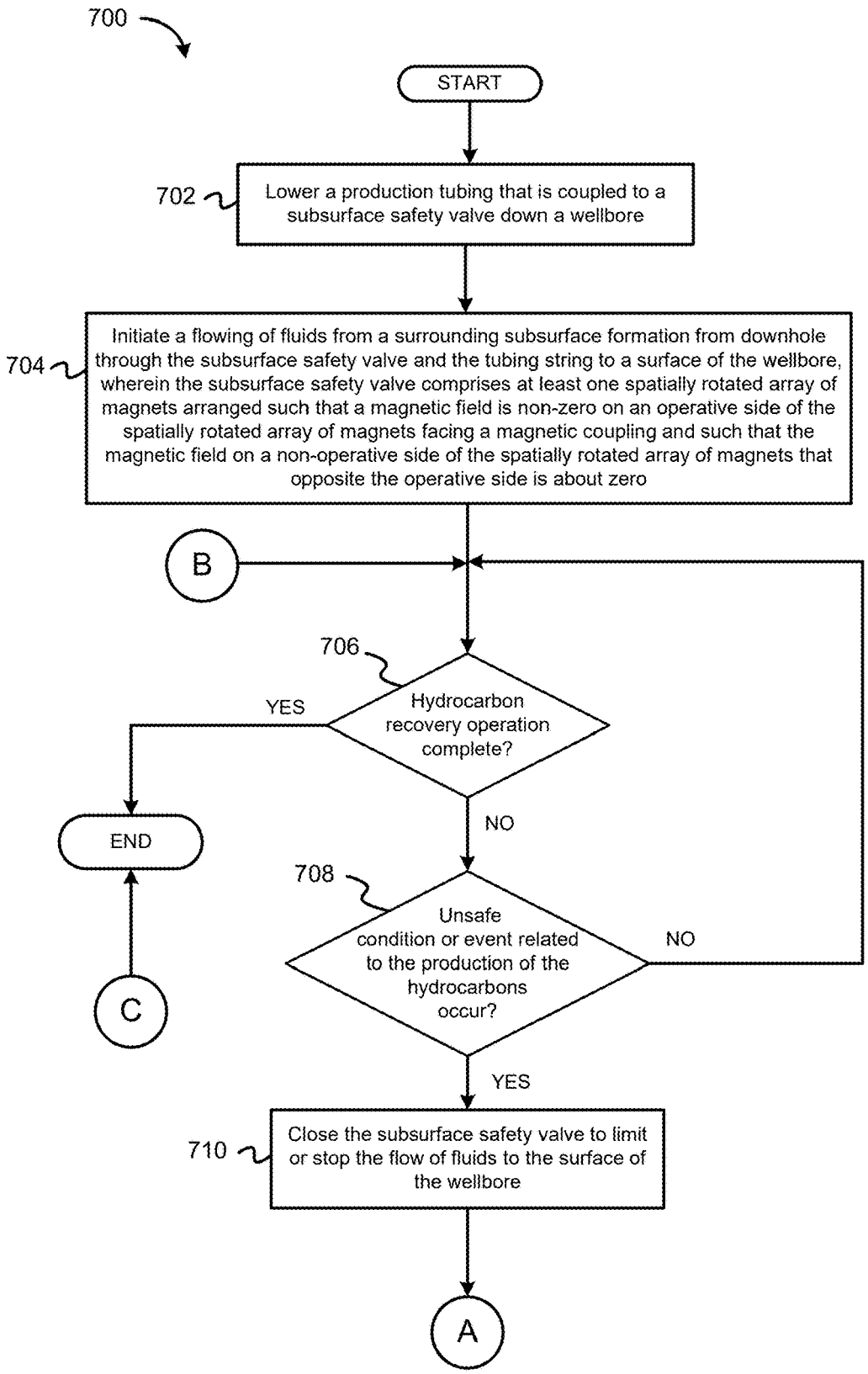
FIGS. 7-8 are flowcharts of example operations of using a subsurface safety valve, according to some implementations.
Figure 8:
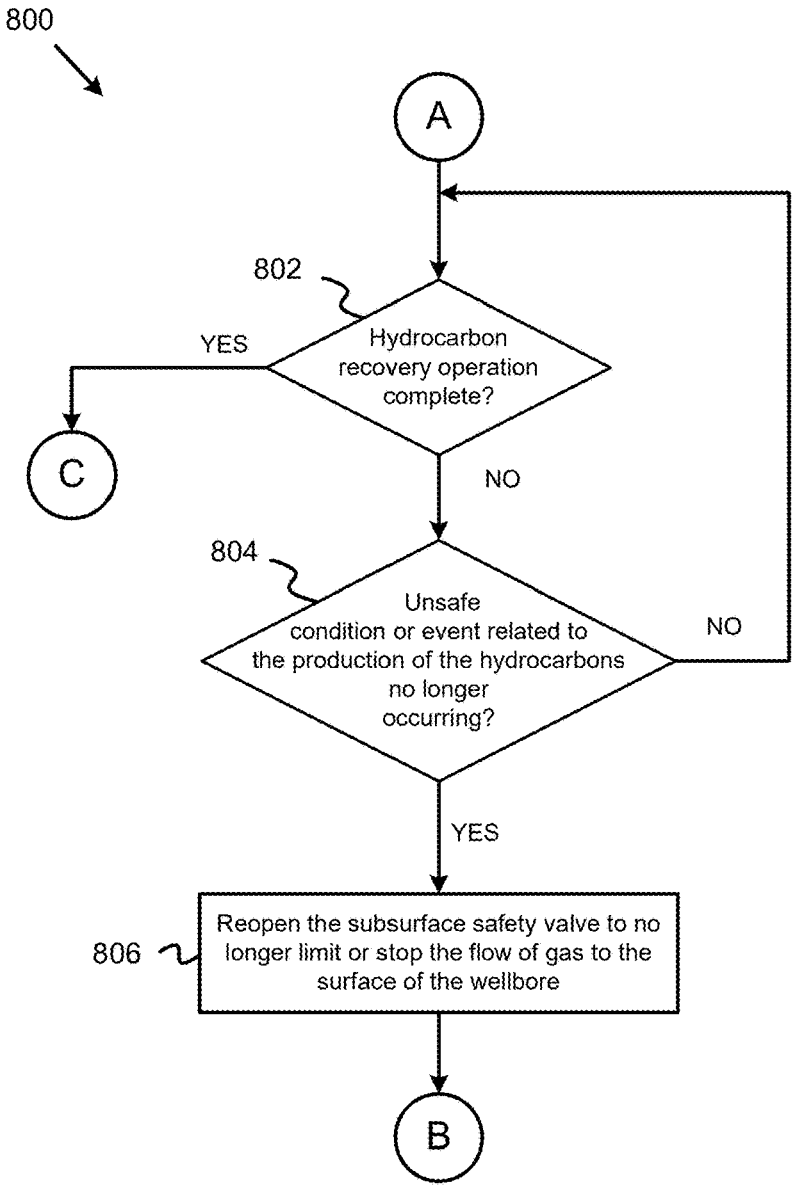

Example operations for using a subsurface safety valve are now described. In particular, FIGS. 7-8 are flowcharts of example operations of using a subsurface safety valve, according to some implementations. Operations of a flowchart 700 and a flowchart 800 of FIGS. 7-8, respectively, can be performed by software, firmware, hardware, or a combination thereof. Operations of the flowcharts 700-800 continue between each other through transition points A-B. Operations of the flowcharts 700-800 are described in reference to FIG. 6. However, other systems and components can be used to perform the operations now described. Operations of the flowchart 700 start at block 702.

At block 702, a production tubing having a subsurface safety valve may be lowered into the wellbore. For example, with reference to FIG. 6, the tubing 614 having the subsurface safety valve 612 may be lowered into the wellbore 608.

At block 704, a flowing of fluids from a surrounding subsurface formation from downhole through the subsurface safety valve and the tubing string to a surface of the wellbore is initiated. The subsurface safety valve may comprise at least one spatially rotated array of magnets arranged such that a magnetic field is non-zero on an operative side of the spatially rotated array of magnets facing a magnetic coupling and such that the magnetic field on a non-operative side of the spatially rotated array of magnets that opposite the operative side is about zero (as described herein). For example, with reference to FIG. 6, fluids from the subterranean formations 610 may below into the wellbore 608 and flow to the surface of the wellbore 608 through the subsurface safety valve 612 and up through the tubing 614.

At block 706, a determination is made of whether the hydrocarbon recovery operation is complete. For example, with reference to FIG. 6, a controller at a surface of the wellbore 608 may be coupled to the control line 616 to control the opening and closing of the subsurface safety valve 612. The controller may be operated to close the subsurface safety valve 612 when it is determined that the hydrocarbon recovery operations are complete (to stop the flow of hydrocarbons from the subterranean formations 610 to the surface of the wellbore 608). If the hydrocarbon recovery operation is complete, operations of the flowcharts 700-800 are complete. Otherwise, operations of the flowchart 700 continue at block 708.

At block 708, a determination is made of whether an unsafe condition or event related to the production of hydrocarbons occurred. For example, with reference to FIG. 6, the controller, operator, etc. may make this determination. For instance, it may be determined that a blowout, release of toxic gases, wellbore collapse, a kick, etc. has occurred in the wellbore 608. If an unsafe condition or event related to the production of hydrocarbons did not occur, operations of the flowchart 700 return to block 706 to again determine if the hydrocarbon recovery operation is complete. Otherwise, operations of the flowchart 700 continue at block 710.

At block 710, the subsurface safety valve is closed to limit or stop the flow of fluids to the surface of the wellbore. For example, with reference to FIG. 6, the controller at a surface of the wellbore 608 may close the subsurface safety valve 612 via the control line 616. For example, with reference to FIG. 1, a controller may cause pressure applied to the hydraulic input 105 to decrease (resulting in the compressed spring 115 to force the drive magnet assembly 113 to move upwards). As the drive magnet assembly 113 moves upwards, the magnetic coupling between the drive magnet assembly 113 and the follower magnet assembly 119 causes the actuator portion 103 to move upward as well. As the lower cap 121 moves above the safety valve flapper 109, the safety valve flapper 109 rotates about the hinge 125 and closes, halting the upward flow of the hydrocarbons. Operations of the flowchart 700 continue at transition point A, which continues at transition point A of the flowchart 800.

Operations of the flowchart 800 are now described. Operations of the flowchart 800 start at transition point A, which continues at block 802.

At block 802, a determination is made of whether the hydrocarbon recovery operation is complete. For example (as described above), with reference to FIG. 6, a controller at a surface of the wellbore 608 may be coupled to the control line 616 to control the opening and closing of the subsurface safety valve 612. The controller may be operated to close the subsurface safety valve 612 when it is determined that the hydrocarbon recovery operations are complete (to stop the flow of hydrocarbons from the subterranean formations 610 to the surface of the wellbore 608). If the hydrocarbon recovery operation is complete, operations of the flowcharts 700-800 are complete. Otherwise, operations of the flowchart 800 continue at block 804.

At block 804, a determination is made of whether the unsafe condition or event related to the production of hydrocarbons is no longer occurring. For example, with reference to FIG. 6, the controller, operator, etc. may make this determination. If an unsafe condition or event related to the production of hydrocarbons is still occurring, operations of the flowchart 800 return to block return to block 802 to again determine if the hydrocarbon recovery operation is complete. Otherwise, operations of the flowchart 800 continue at block 806.

At block 806, the subsurface safety valve is reopened to no longer limit or stop the flow of fluids to the surface of the wellbore. For example, with reference to FIG. 6, the controller at a surface of the wellbore 608 may reopen the subsurface safety valve 612 via the control line 616. For example, with reference to FIG. 1, hydraulic pressure is applied to the drive mechanism 111 via the hydraulic input 105. The hydraulic pressure causes the drive mechanism 111 to apply force to the drive magnet assembly 113, causing the drive magnet assembly 113 to compress the spring 115. Thus, the hydraulic pressure applied via the hydraulic input 105 causes the drive portion 101 to move linearly within the outer housing 129 (downward, in this example). Because the drive magnet assembly 113 is magnetically coupled to the follower magnet assembly 119, as the drive portion 101 moves downward, the actuator portion 103 also moves downward within the outer housing 129. As the actuator portion 103 moves down within the outer housing 129, the lower cap 121 makes contact with the safety valve flapper 109, causing the safety valve flapper 109 to rotate about hinge 125 and open. When open, the safety valve flapper 109 allows hydrocarbons to flow upwards.

Operations of the flowchart 800 continue at transition point B, which continues at transition point B of the flowchart 700, which continues at transition point B. From transition point B of the flowchart 700, operations of the flowchart 700 continue at block 706 (where a determination is again made of whether the hydrocarbon operation is complete).

Figure 9:
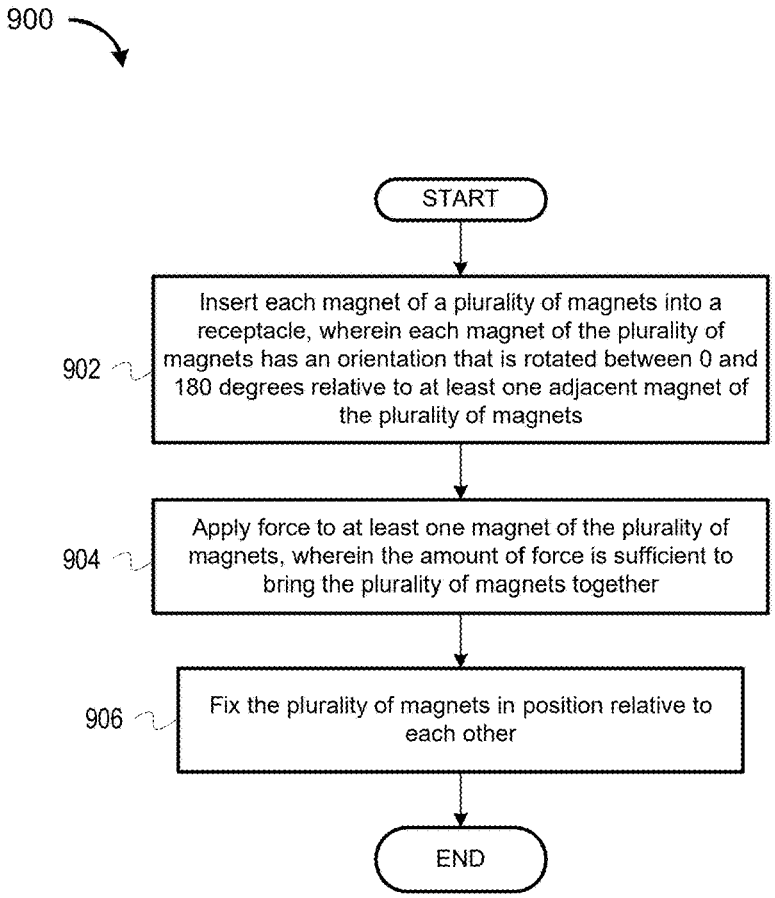
FIG. 9 is a flowchart of example operations for manufacturing a subsurface safety valve or component thereof, according to some implementations.

FIG. 9 is a flowchart of example operations for manufacturing a subsurface safety valve or component thereof, according to some implementations. Operations of a flowchart 900 of FIG. 9 can be performed by one or more persons, one or more machines, software, firmware, hardware, or any combination thereof. Operations of flowchart 900 are described in reference to FIG. 3. However, the operations can be adapted to other implementations. Operations of flowchart 900 start at block 902.

At block 902, each magnet of a plurality of magnets is inserted into a receptacle. Each magnet of the plurality of magnets has an orientation that is rotated between 0 and 180 degrees relative to at least one adjacent magnet of the plurality of magnets.

For example, with reference to FIG. 3, a receptacle may be defined by the first end 303, the second end 305, the backing plate 307, and the top plate 309 and one of the first end 303, second end 305, or other portion may be open, thereby allowing the insertion of the first magnet 311A. The first magnet 311A of the plurality of magnets 311A-311N may be inserted into the receptacle, followed by the second magnet 311B, the third magnet 311C, the fourth magnet 311D, etc. As illustrated in FIG. 3, the first magnet 311A has an orientation that is rotated 90 degrees relative to the second magnet 311B, the second magnet 311B has an orientation that is rotated 90 degrees relative to the first magnet 311A and the second magnet 311C, etc.

The specific form of the receptacle can vary between implementations and may be a tube, a pocket, a rod, a wellbore, etc. For example, in some implementations the receptacle may be a rod onto which each magnet of the plurality of magnets is placed or which is inserted into each magnet of the plurality of magnets. As another example, in some implementations the magnets may be placed directly into the wellbore or a pocket in the wellbore created by an outer wall, a pressure separator, a drive mechanism, and a spring. It is understood that the phrase "inserted into a receptacle" includes scenarios where the magnets are held in place and the receptacle moved, where a rod is inserted into the magnets, the magnets are placed onto a rod, etc.

At block 904, force is applied to at least one magnet of the plurality of magnets, wherein the amount of force is sufficient to bring the plurality of magnets together. The magnets of the plurality of magnets may generate magnetic fields that repel each other, thus the amount of force applied is sufficient to overcome each magnet of the plurality of magnets repelling each other. The particular amount of force applied can vary depending on the strength of the magnets, the orientation of the magnets, etc.

It should be noted that, in some implementations, there may be a gap between the magnets of the plurality of magnets and the force applied may vary depending on the desired gap. Thus, the force applied for implementations in which the magnets of the plurality of magnets should be in contact with each other may be greater than the force applied for implementations in which the magnets of the plurality of magnets have a gap between them.

The specific mechanism used to apply the force to the at least one magnet of the plurality of magnets may vary depending on the implementation. Example mechanisms include a mechanical press, a hydraulic press, a pneumatic device, a fastening mechanism (e.g., a bolt and nut), etc.

At block 906, the plurality of magnets are fixed in position relative to each other. The specific mechanism used to fix the plurality of magnets in position may vary between implementations. For example, for tubular receptacles and the like, the magnets may be pressed into the receptacle at block 904 via an open end and then the open end may be welded, screwed, clamped, adhesively bonded, etc. For rod-like receptacles, the plurality of magnets may be brought together at block 904 by the force of a nut being screwed onto the rod-like receptacle and then the nut may be fixed using a mechanism to prevent the nut from turning (e.g., a pin placed through the rod and nut, a weld, etc.). In some implementations, adhesive may be placed between the magnets of the plurality of magnets such that when the magnets of the plurality of magnets are brought in contact with each other at block 904, the adhesive sets and causes the magnets of the plurality of magnets to adhere to each other. In some implementations, each magnet of the plurality of magnets is fixed in place individually. For example, in a receptacle defined by a first side, a second side, and a back side, each magnet may be individually placed in the receptacle and then fixed to the backside via individual fasteners or adhesives.

Figure 10:
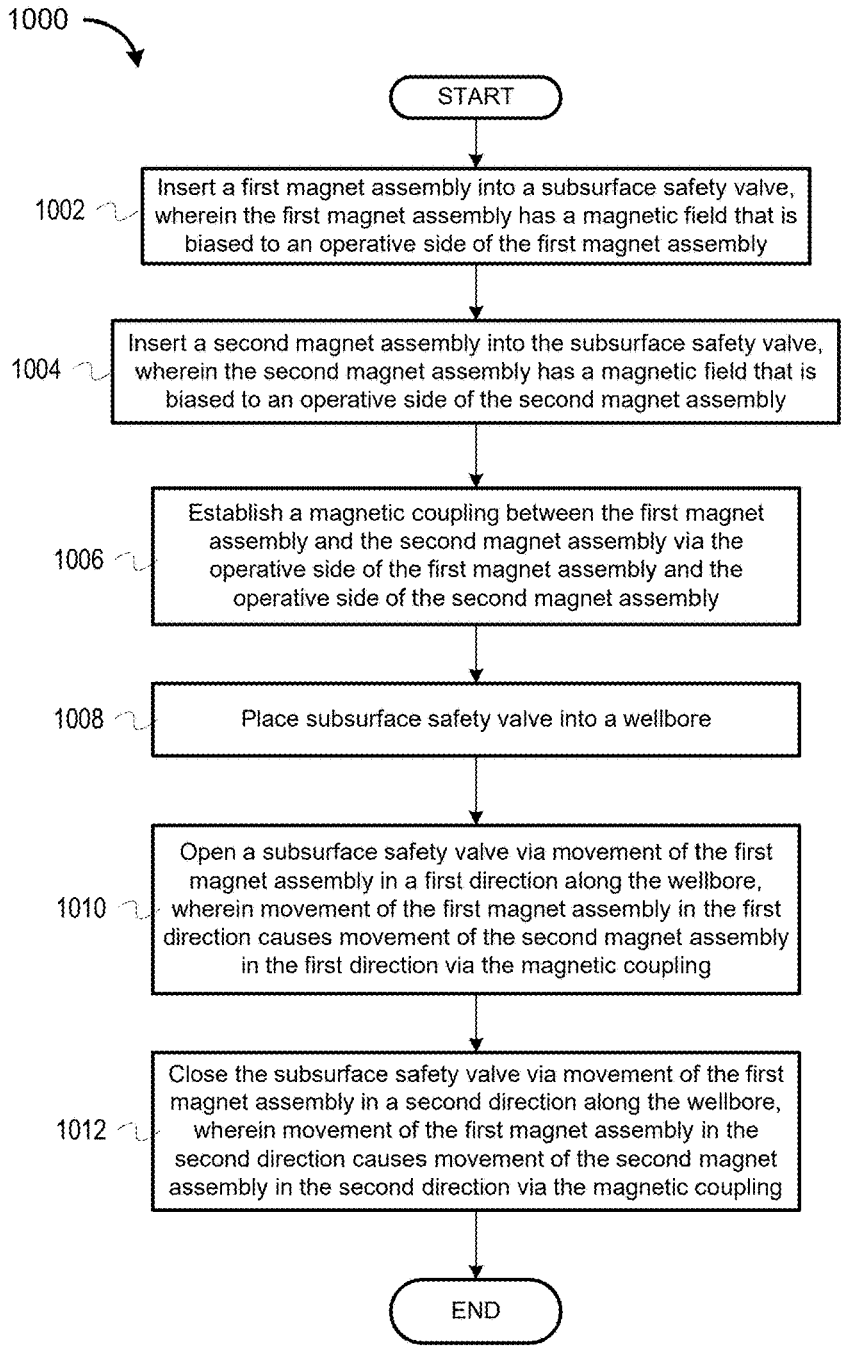
FIG. 10 is a flowchart of example operations for placing and operating a subsurface safety valve in a wellbore, according to some implementations.

FIG. 10 is a flowchart of example operations for placing and operating a subsurface safety valve in a wellbore, according to some implementations. Operations of a flowchart 1000 of FIG. 10 can be performed by one or more persons, one or more machines, software, firmware, hardware, or any combination thereof. Operations of flowchart 1000 are described in reference to FIG. 1 and FIG. 6. However, the operations can be adapted to other implementations. Operations of flowchart 1000 start at block 1002.

At block 1002, a first magnet assembly is inserted into a subsurface safety valve. The first magnet assembly has a magnetic field that is biased to an operative side of the first magnet assembly. For example, with reference to FIG. 1, the drive magnet assembly 113 may be inserted into the subsurface safety valve 100. The drive magnet assembly 113 may be inserted into the subsurface safety valve 100 alone or as part of a larger component, such as the drive portion 101.

At block 1004, a second magnet assembly is inserted into the subsurface safety valve. The second magnet assembly has a magnetic field that is biased to an operative side of the second magnet assembly. For example, with reference to FIG. 1, the follower magnet assembly 119 may be inserted into the subsurface safety valve 100. The follower magnet assembly 119 may be inserted into the subsurface safety valve 100 alone or as part of a larger component, such as the actuator portion 103.

At block 1006, a magnetic coupling between the first magnet assembly and the second magnet assembly is established via the operative side of the first magnet assembly and the operative side of the second magnet assembly. For example, with reference to FIG. 1, a magnetic coupling between the drive magnet assembly 113 and the follower magnet assembly 119 may be established by inserting the drive magnet assembly 113 and the follower magnet assembly 119 into the subsurface safety valve 100 such that the operative side of each magnet assembly is oriented towards the other magnet assembly and then placed such that magnetic field generated by each magnet assembly interacts with the magnetic field of the other magnet assembly.

At block 1008, the subsurface safety valve is placed into a wellbore. The subsurface safety valve may be placed into the wellbore by lowering production tubing having the subsurface safety valve into the wellbore. For example, with reference to FIG. 6, the tubing 614 having the subsurface safety valve 612 may be lowered into the wellbore 608.

At block 1010, the subsurface safety valve is opened via movement of the first magnet assembly in a first direction along the wellbore. Movement of the first magnet assembly in the first direction causes movement of the second magnet assembly in the first direction via the magnetic coupling. For example, with reference to FIG. 1, the drive magnet assembly 113 may be moved linearly in a first direction within the outer housing 129 via hydraulic pressure applied via the hydraulic input 105. As the drive magnet assembly 113 moves linearly in the first direction within the outer housing 129, the follower magnet assembly 119 moves linearly in the first direction within the outer housing 129 with the drive magnet assembly 113 via the magnetic coupling. When the follower magnet assembly 119 moves a sufficient amount (e.g., a predetermined distance) in the first direction within the outer housing 129, the subsurface safety valve 100 begins to open and continues to further open as the follower magnet assembly 119 moves further within the outer housing 129.

At block 1012, the subsurface safety valve is closed via movement of the first magnet assembly in a second direction along the wellbore. Movement of the first magnet assembly in the second direction causes movement of the second magnet assembly in the second direction via the magnetic coupling. For example, with reference to FIG. 1, the drive magnet assembly 113 may be moved linearly in a second direction within the outer housing 129 via force applied by the spring 115 as the pressure from the hydraulic input 105 is lessened. As the drive magnet assembly 113 moves linearly in the second direction within the outer housing 129, the follower magnet assembly 119 moves linearly in the second direction within the outer housing 129 with the drive magnet assembly 113 via the magnetic coupling. As the follower magnet assembly 119 moves in the second direction within the outer housing 129, it begins to close the subsurface safety valve 100 and continues to further close the subsurface safety valve 100 as the follower magnet assembly 119 moves further within the outer housing 129. After moving a sufficient amount (e.g., a predetermined distance) in the second direction within the outer housing 129, the subsurface safety valve 100 closes.

As noted herein, a subsurface safety valve may be implemented with one magnet assembly having a magnetic field that is biased to an operative side of the magnet assembly or multiple magnet assemblies each having a magnetic field that is biased to operative sides of the respective magnet assemblies. As such, the operations depicted in FIG. 10 may be modified accordingly for implementations that only use one magnet assembly having a magnetic field that is biased to an operative side of the magnet assembly. For example, the operations described at block 1004 may not be performed for some implementations.

Also as noted herein, a wellbore and subsurface safety valve may be tubular in shape and multiple drive magnet assemblies may be placed around the drive portion of a subsurface safety valve with corresponding follower magnet assemblies placed around the actuator portion of the subsurface safety valve. In these implementations, the operations performed at blocks 1002 and 1004 may be performed for each drive magnet assembly/follower magnet assembly pair.

In some implementations, the magnet assemblies may be placed into the subsurface safety valve after the subsurface safety valve is placed in the wellbore. In such implementations, the operations performed at block 1008 may be performed prior to the operations performed at blocks 1002, 1004, and 1006.

A magnet coupling may be established when the magnet assemblies come within a particular range of each other and thus a magnetic coupling may be established as part of the operations performed at blocks 1002 and 1004 instead of as a separate operation.

While the aspects of the disclosure are described with reference to various implementations and exploitations, it will be understood that these aspects are illustrative and that the scope of the claims is not limited to them. In general, techniques for implementing a safety valve actuating mechanism with a magnetic coupling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Implementations

Implementation 1: A subsurface safety valve for a wellbore for production of fluids from a subsurface formation, the subsurface safety valve comprising: a drive portion comprising a first magnet assembly; and an actuator portion comprising a second magnet assembly magnetically coupled to the first magnet assembly, wherein at least one of the first magnet assembly or the second magnet assembly comprises a spatially rotated array of magnets arranged such that a magnetic field emitted from an operative side of the spatially rotated array of magnets facing a magnetic coupling is non-zero and such that the magnetic field emitted from a non-operative side of the spatially rotated array of magnets that opposite the operative side is about zero.

Implementation 2: The subsurface safety valve of Implementation 1, wherein the spatially rotated array of magnets comprises sequential magnets at different orientations in a spatially rotating pattern of magnetization.

Implementation 3: The subsurface safety valve according to any of the preceding Implementations, further comprising an outer housing in which the drive portion and the actuator portion are positioned, wherein the outer housing is composed of a ferromagnetic material or a ferrous material.

Implementation 4: The subsurface safety valve according to any of the preceding Implementations, wherein the outer housing is composed of a ferromagnetic steel.

Implementation 5: The subsurface safety valve according to any of the preceding Implementations, wherein in response to the drive portion moving axially within the wellbore, the actuator portion is to axially move within the wellbore to open and close the safety valve based on the magnetic coupling between the first magnet assembly and the second magnet assembly.

Implementation 6: The subsurface safety valve according to any of the preceding Implementations, wherein the first magnet assembly comprises a first spatially rotated array of magnets arranged such that a magnetic field is non-zero on a first operative side of the first spatially rotated array of magnets facing a magnetic coupling toward the actuator portion and such that a magnetic field on a first non-operative side of the first spatially rotated array of magnets that opposite the operative side is about zero, wherein the second magnet assembly comprises a second spatially rotated array of magnets arranged such that a magnetic field is non-zero on a second operative side of the second spatially rotated array of magnets facing a magnetic coupling toward the drive portion and such that a magnetic field on a second non-operative side of the second spatially rotated array of magnets that opposite the operative side is about zero, and wherein the first operative side is oriented towards the second magnet assembly and wherein the second operative side is oriented towards the first magnet assembly.

Implementation 7: The subsurface safety valve of any of the above Implementations, wherein each magnet of the first spatially rotated array of magnets has an orientation that is rotated about 90 degrees relative to at least one adjacent magnet in the first spatially rotated array of magnets or each magnet of the second spatially rotated array of magnets has an orientation that is rotated about 90 degrees relative to at least one adjacent magnet in the second spatially rotated array of magnets.

Implementation 8: The subsurface safety valve of any of the above Implementations, wherein each magnet of the first spatially rotated array of magnets has an orientation that is rotated approximately 90 degrees relative to at least one adjacent magnet in the first spatially rotated array of magnets or each magnet of the second spatially rotated array of magnets has an orientation that is rotated approximately 90 degrees relative to at least one adjacent magnet in the second spatially rotated array of magnets.

Implementation 9: A wellbore system comprising: a production tubing extendable within a wellbore; and a subsurface safety valve to be interconnected with the production tubing, the subsurface safety valve comprising, a drive portion comprising a first magnet assembly; and an actuator portion comprising a second magnet assembly magnetically coupled to the first magnet assembly, wherein at least one of the first magnet assembly or the second magnet assembly comprises a spatially rotated array of magnets arranged such that a magnetic field emitted from an operative side of the spatially rotated array of magnets facing a magnetic coupling is non-zero and such that the magnetic field emitted from a non-operative side of the spatially rotated array of magnets that opposite the operative side is about zero.

Implementation 10: The wellbore system according to any of the preceding Implementations, wherein the spatially rotated array of magnets comprises sequential magnets at different orientations in a spatially rotating pattern of magnetization.

Implementation 11: The wellbore system according to any of the preceding Implementations, further comprising an outer housing in which the drive portion and the actuator portion are positioned, wherein the outer housing is composed of a ferromagnetic material or a ferrous material.

Implementation 12: The wellbore system according to any of the preceding Implementations, wherein the outer housing is composed of a ferromagnetic steel.

Implementation 13: The wellbore system according to any of the preceding Implementations, wherein in response to the drive portion moving axially within the wellbore, the actuator portion is to axially move within the wellbore to open and close the subsurface safety valve based on the magnetic coupling between the first magnet assembly and the second magnet assembly.

Implementation 14: The wellbore system according to any of the preceding Implementations, wherein the first magnet assembly comprises a first spatially rotated array of magnets arranged such that a magnetic field is non-zero on a first operative side of the first spatially rotated array of magnets facing a magnetic coupling toward the actuator portion and such that a magnetic field on a first non-operative side of the first spatially rotated array of magnets that opposite the operative side is about zero, wherein the second magnet assembly comprises a second spatially rotated array of magnets arranged such that a magnetic field is non-zero on a second operative side of the second spatially rotated array of magnets facing a magnetic coupling toward the drive portion and such that a magnetic field on a second non-operative side of the second spatially rotated array of magnets that opposite the operative side is about zero, and wherein the first operative side is oriented towards the second magnet assembly and wherein the second operative side is oriented towards the first magnet assembly.

Implementation 15: The wellbore system according to any of the preceding Implementations, wherein each magnet of the first spatially rotated array of magnets has an orientation that is rotated about 90 degrees relative to at least one adjacent magnet in the first spatially rotated array of magnets or each magnet of the second spatially rotated array of magnets has an orientation that is rotated about 90 degrees relative to at least one adjacent magnet in the second spatially rotated array of magnets.

Implementation 16: The subsurface safety valve according to any of the preceding Implementations, wherein each magnet of the first spatially rotated array of magnets has an orientation that is rotated approximately 90 degrees relative to at least one adjacent magnet in the first spatially rotated array of magnets or each magnet of the second spatially rotated array of magnets has an orientation that is rotated approximately 90 degrees relative to at least one adjacent magnet in the second spatially rotated array of magnets.

Implementation 17: A method for manufacturing a subsurface safety valve, the method comprising: inserting each magnet of a plurality of magnets into a receptacle, wherein each magnet of the plurality of magnets has an orientation that is rotated between 0 and 180 degrees relative to at least one adjacent magnet of the plurality of magnets; applying force to at least magnet of the plurality of magnets, wherein an amount of force is sufficient to bring the plurality of magnets together; and fixing the magnets of the plurality of magnets in position relative to each other.

Implementation 18: The method according to any of the preceding Implementations, wherein said inserting each magnet of the plurality of magnets into the receptacle comprises inserting a rod into through each magnet of the plurality of magnets.

Implementation 19: The method according to any of the preceding Implementations, wherein the receptacle comprises at least one of an enclosure around the magnets, a tension rod that passes through the magnet, and a bracket.

Implementation 20: The method according to any of the preceding Implementations, wherein each magnet of the plurality of magnets has an orientation that is rotated about 90 degrees relative to at least one adjacent magnet of the plurality of magnets.

The invention claimed is:

1. A subsurface safety valve for a wellbore for production of fluids from a subsurface formation, the subsurface safety valve comprising:

a drive portion comprising a first magnet assembly, wherein the first magnet assembly comprises a first spatially rotated array of magnets arranged such that a magnetic field emitted from a first operative side of the first spatially rotated array of magnets facing a magnetic coupling is non-zero and such that a magnetic field emitted from a first non-operative side of the first spatially rotated array of magnets that is opposite the first operative side is about zero, wherein the first operative side of the first spatially rotated array of magnets is oriented toward a center of the wellbore; and an actuator portion comprising a second magnet assembly magnetically coupled to the first magnet assembly.

2. The subsurface safety valve of claim 1, wherein the first spatially rotated array of magnets comprises sequential magnets at different orientations in a spatially rotating pattern of magnetization.

3. The subsurface safety valve of claim 1, further comprising an outer housing in which the drive portion and the actuator portion are positioned, wherein the outer housing is composed of a ferromagnetic material or a ferrous material.

4. The subsurface safety valve of claim 3, wherein the outer housing is composed of a ferromagnetic steel.

5. The subsurface safety valve of claim 1, wherein in response to the drive portion moving axially within the wellbore, the actuator portion is to axially move within the wellbore to open and close the safety valve based on the magnetic coupling between the first magnet assembly and the second magnet assembly.

6. The subsurface safety valve of claim 1, wherein the second magnet assembly comprises a second spatially rotated array of magnets arranged such that a magnetic field is non-zero on a second operative side of the second spatially rotated array of magnets facing a magnetic coupling toward the drive portion and such that a magnetic field on a second non-operative side of the second spatially rotated array of magnets that is opposite the second operative side is about zero, and wherein the first operative side being oriented toward the center of the wellbore comprises the first operative side being oriented towards the second magnet assembly and wherein the second operative side is oriented towards the first magnet assembly.

7. The subsurface safety valve of claim 6, wherein each magnet of the first spatially rotated array of magnets has an orientation that is rotated about 90 degrees relative to at least one adjacent magnet in the first spatially rotated array of magnets or each magnet of the second spatially rotated array of magnets has an orientation that is rotated about 90 degrees relative to at least one adjacent magnet in the second spatially rotated array of magnets.

8. The subsurface safety valve of claim 6, wherein each magnet of the first spatially rotated array of magnets has an orientation that is rotated approximately 90 degrees relative to at least one adjacent magnet in the first spatially rotated array of magnets or each magnet of the second spatially rotated array of magnets has an orientation that is rotated approximately 90 degrees relative to at least one adjacent magnet in the second spatially rotated array of magnets.

9. The subsurface safety valve of claim 6, wherein the first magnet assembly and the second magnet assembly are arranged concentrically.

10. The subsurface safety valve of claim 6, wherein the first magnet assembly and the second magnet assembly are axially aligned.

11. A wellbore system comprising:

a production tubing extendable within a wellbore; and a subsurface safety valve to be interconnected with the production tubing, the subsurface safety valve comprising, a drive portion comprising a first magnet assembly, wherein the first magnet assembly comprises a first spatially rotated array of magnets arranged such that a magnetic field emitted from a first operative side of the first spatially rotated array of magnets facing a magnetic coupling is non-zero and such that the magnetic field emitted from a first non-operative side of the first spatially rotated array of magnets that is opposite the first operative side is about zero, wherein the first operative side of the first spatially rotated array of magnets is oriented toward a center of the wellbore; and an actuator portion comprising a second magnet assembly magnetically coupled to the first magnet assembly.

12. The wellbore system of claim 11, wherein the first spatially rotated array of magnets comprises sequential magnets at different orientations in a spatially rotating pattern of magnetization.

13. The wellbore system of claim 11, further comprising an outer housing in which the drive portion and the actuator portion are positioned, wherein the outer housing is composed of a ferromagnetic material or a ferrous material.

14. The wellbore system of claim 13, wherein the outer housing is composed of a ferromagnetic steel.

15. The wellbore system of claim 11, wherein in response to the drive portion moving axially within the wellbore, the actuator portion is to axially move within the wellbore to open and close the subsurface safety valve based on the magnetic coupling between the first magnet assembly and the second magnet assembly.

16. The wellbore system of claim 11, wherein the second magnet assembly comprises a second spatially rotated array of magnets arranged such that a magnetic field is non-zero on a second operative side of the second spatially rotated array of magnets facing a magnetic coupling toward the drive portion and such that a magnetic field on a second non-operative side of the second spatially rotated array of magnets that is opposite the second operative side is about zero, and wherein the first operative side being oriented towards the center of the wellbore comprises the first operative side being oriented towards the second magnet assembly and wherein the second operative side is oriented towards the first magnet assembly.

17. The wellbore system of claim 16, wherein each magnet of the first spatially rotated array of magnets has an orientation that is rotated about 90 degrees relative to at least one adjacent magnet in the first spatially rotated array of magnets or each magnet of the second spatially rotated array of magnets has an orientation that is rotated about 90 degrees relative to at least one adjacent magnet in the second spatially rotated array of magnets.

18. The subsurface safety valve of claim 16, wherein each magnet of the first spatially rotated array of magnets has an orientation that is rotated approximately 90 degrees relative to at least one adjacent magnet in the first spatially rotated array of magnets or each magnet of the second spatially rotated array of magnets has an orientation that is rotated approximately 90 degrees relative to at least one adjacent magnet in the second spatially rotated array of magnets.

19. The wellbore system of claim 16, wherein the first magnet assembly and the second magnet assembly are arranged concentrically.

20. The wellbore system of claim 16, wherein the first magnet assembly and the second magnet assembly are axially aligned.

21. A method for manufacturing a subsurface safety valve, the method comprising:

manufacturing a magnet assembly having a magnetic field that is biased to an operative side of the magnet assembly comprising inserting each magnet of a plurality of magnets into a receptacle, wherein each magnet of the plurality of magnets has an orientation that is rotated between 0 and 180 degrees relative to at least one adjacent magnet of the plurality of magnets;

applying an amount of force to at least one magnet of the plurality of magnets, wherein the amount of force is sufficient to bring the plurality of magnets together; and fixing the magnets of the plurality of magnets in position relative to each other, and inserting the magnet assembly into the subsurface safety valve such that the operative side of the magnet assembly is oriented toward a center axis of the subsurface safety valve.

22. The method of claim 21, wherein said inserting each magnet of the plurality of magnets into the receptacle comprises inserting a rod through each magnet of the plurality of magnets.

23. The method of claim 21, wherein the receptacle comprises at least one of an enclosure around the magnets, a tension rod that passes through the magnets, and a bracket.

24. The method of claim 21, wherein each magnet of the plurality of magnets has an orientation that is rotated about 90 degrees relative to at least one adjacent magnet of the plurality of magnets.

* * * * *